US012408814B2

(12) United States Patent
Lin

(10) Patent No.: US 12,408,814 B2
(45) **Date of Patent: *Sep. 9, 2025**

(54) AIR TUBE OF SHOE DRYER

(71) Applicant: Chengchuan Lin, Xiamen (CN)

(72) Inventor: Chengchuan Lin, Xiamen (CN)

( * ) Notice: Subject to any disclaimer, the term of this patent is extended or adjusted under 35 U.S.C. 154(b) by 809 days.

This patent is subject to a terminal disclaimer.

(21) Appl. No.: 17/696,832

(22) Filed: Mar. 16, 2022

(65) Prior Publication Data

US 2022/0304547 A1 Sep. 29, 2022

(30) Foreign Application Priority Data

Mar. 29, 2021 (CN) ..... 202120635268.8

(51) Int. Cl.
*A47L 23/20* (2006.01)

(52) U.S. Cl.
CPC ..... *A47L 23/20* (2013.01)

(58) Field of Classification Search
CPC ..... A47L 23/20
USPC ..... 34/104
See application file for complete search history.

(56) References Cited

U.S. PATENT DOCUMENTS 386,746 A * 7/1888 Hess ..... F26B 21/006 34/104
2,614,337 A * 10/1952 Darbo ..... A47L 23/205 34/104
3,417,482 A * 12/1968 Peet ..... A47L 23/20 392/347
4,768,293 A * 9/1988 Kaffka ..... A47L 23/205 392/383
5,287,636 A * 2/1994 Lafleur ..... F26B 21/006 34/239
5,555,640 A * 9/1996 Ou ..... F26B 25/066 312/249.9
9,890,997 B2 * 2/2018 Montes ..... F26B 21/004
11,723,460 B1 * 8/2023 Allen ..... D06F 58/00 211/85.7
11,957,293 B2 * 4/2024 Lin ..... A47L 23/205
2022/0304547 A1 * 9/2022 Lin ..... A47L 23/20
2023/0380658 A1 * 11/2023 Lin ..... A47L 23/205
2024/0263381 A1 * 8/2024 Lin ..... D06F 59/04
2024/0295206 A1 * 9/2024 Svensson ..... F02M 61/14

FOREIGN PATENT DOCUMENTS

CN 216205106 U * 4/2022 ..... A47L 23/20
CN 220269861 U * 12/2023 ..... D06F 59/04

* cited by examiner

*Primary Examiner* — Stephen M Gravini

(57) ABSTRACT

An air tube of a shoe dryer is provided. A top of the air tube has at least one air outlet. An air passage is formed in the air tube. A top surface of the air tube is provided with at least one support rib. At least one guide passage is provided on an outer side wall of the air tube or inside the air tube. The guide passage is independent of the air passage of the air tube. The air tube of the shoe dryer can prevent the backflow of warm air when the air tube is in operation and improve the convective drying efficiency.

12 Claims, 9 Drawing Sheets

AIR TUBE OF SHOE DRYER

BACKGROUND OF THE INVENTION

1. Field of the Invention

The present invention relates to a shoe dryer, and more particularly to an air tube of a shoe dryer.

2. Description of the Prior Art

In daily life, shoes may be damped due to sweat. In rainy and snowy weather, it is easier to wet the shoes. The inside of wet shoes cannot be dried in a short time by natural air drying. A shoe dryer is developed accordingly. For some cold-proof boots, the boots are tall and have fluff in the boots. It is more difficult to dry the boots after getting wet.

A conventional shoe dryer is provided with an air tube for warm air to flow out of the shoe dryer. The top of the air tube has multiple air outlets. When the shoe is placed on the air tube, the air outlets are easily blocked and jammed by the fabric on the inner surface of the shoe, especially the shoe having fluff inside the shoe. In the process of heating the air, the fluff is expanded due to heat or static electricity, which is easy to block the air outlets. The wind resistance is formed on the wall of the air tube, which blocks the convection. It will cause the warm air to flow back into the air tube to generate heat accumulation and cause the wind wheel to be deformed or damaged by heat. The high temperature is more likely to cause safety hazards. Furthermore, since the air in the shoe cannot form an airflow circulation, the convective drying efficiency inside the shoe will be low. In addition, most of the air tubes of the conventional shoe dryers need a separate shoe support or a support member as a support to form a convection space. Many parts need to be assembled separately. It is not easy to store and carry the shoe dryer. The effect is not good.

Accordingly, the inventor of the present invention has devoted himself based on his many years of practical experiences to solve these problems.

SUMMARY OF THE INVENTION

The primary object of the present invention is to provide an air tube of a shoe dryer, which can prevent the backflow of wane air when the air tube is in operation and improve the convective drying efficiency.

In order to achieve the above-mentioned object, the technical solutions of the present invention are as follows:

An air tube of a shoe dryer is provided. A top of the air tube has at least one air outlet. An air passage is formed in the air tube. A top surface of the air tube is provided with at least one support rib. At least one guide passage is provided on an outer side wall of the air tube or inside the air tube. The guide passage is independent of the air passage of the air tube.

Preferably, both ends of the guide passage are formed with openings. The openings are located on the outer side wall of the air tube. The opening at the upper end of the guide passage is lower than the air outlet on the top of the air tube.

Preferably, the guide passage is integrally formed with the air tube.

Preferably, the guide passage is formed through a half-closed shell surrounding the wall of the air tube.

Preferably, at least one end of the support rib extends downward to form a guide rib, and the guide rib is integrally formed on the outer side wall of the air tube.

Preferably, the top surface of the air tube is provided with two support ribs. At least one end of each support rib extends downward to a side wall of the air tube. The side wall of the air tube is formed with at least one pair of guide ribs extending downward to a lower end of the air tube. The guide passage on the outer wall of the air tube is located between the two guide ribs.

Preferably, the top surface of the air tube is provided with two support ribs extending forward. A baffle is provided between the two support ribs. The baffle is located at a front end of the top surface of the air tube. The baffle is located above the guide passage.

Preferably, the air outlet includes a top air outlet area on the top surface of the air tube and a side air outlet area on a front side of the air tube. The baffle is located in front of the side air outlet area.

Preferably, the baffle has at least one ventilation hole.

Preferably, front ends of the two support ribs are provided with a bar. A ventilation area is formed between the bar and the baffle.

Preferably, the air tube is a hollow round, square or oval tube.

With the above-mentioned technical solutions, in the present invention, the top surface of the air tube is provided with a support rib, and at least one guide passage is provided on the outer side wall of the air tube or inside the air tube. When in use, a shoe is placed on the top of the air tube, and a support space is defined between the support rib and the side wall of the air tube. Due to the guide passage on the side wall of the air tube, an airflow channel for air circulation is formed inside the shoe body, which can effectively avoid the backflow of warm air and improve the convective drying efficiency inside the shoe. It is safer to use shoe dryer.

DETAILED DESCRIPTION OF THE PREFERRED EMBODIMENTS

Embodiments of the present invention will now be described, by way of example only, with reference to the accompanying drawings.

Figure 1:
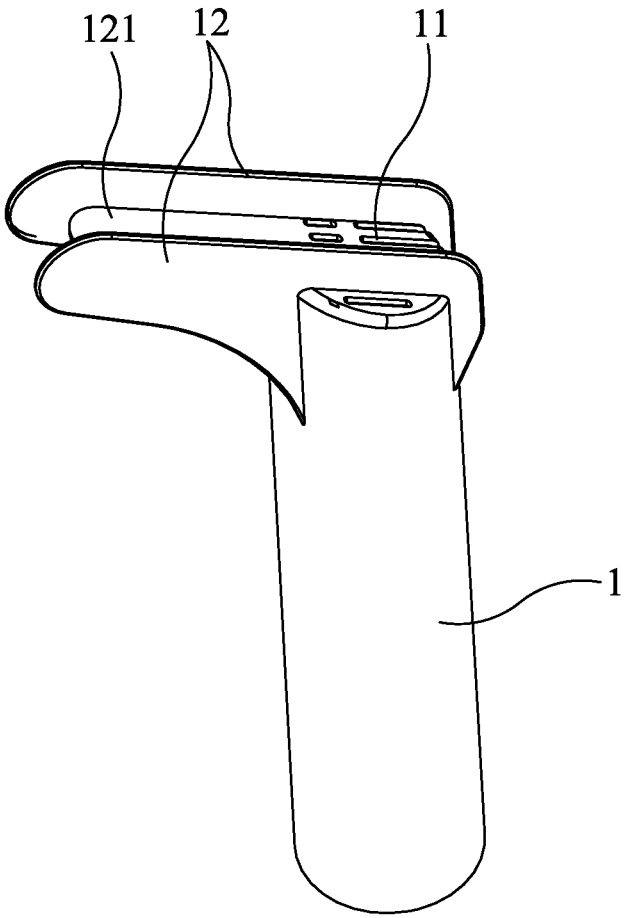
FIGS. 1-3 are perspective views according to a first embodiment of the present invention.
Figure 2:
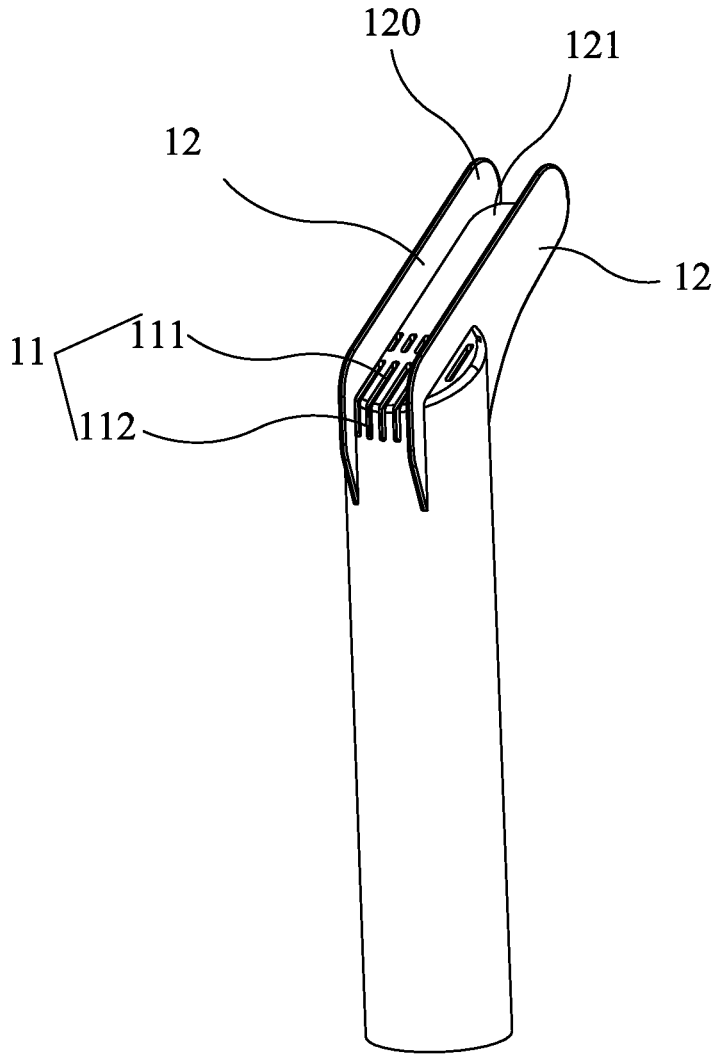

As shown in FIG. 1 through FIG. 4, the present invention discloses an air tube 1 of a shoe dryer. The top of the air tube 1 has at least one air outlet 11. An air passage 10 is formed in the air tube 1. The warm air is discharged from the air outlet 11 after passing through the air passage 10. When in use, the air tube 1 is inserted in a shoe for drying the shoe. The present invention can not only be used for drying shoes, but also can be used for drying items that are easily damped, such as helmets, socks and gloves. The top surface of the air tube 1 is provided with at least one support rib 12. When the shoe is placed on the top of the air tube 1, a support space is defined between the support rib 12 and the side wall of the air tube 1. The inner surface of the shoe is supported to be away from the air outlet 11, so as to prevent the air outlet 11 from being blocked or jammed by the cloth or fluff on the inner surface of the shoe. The air outlet 11 may include a top air outlet area 111 on the top of the air tube 1 and a side air outlet area 112 on the side of the air tube 1. The air outlet 11 may be in the form of a plurality of elongated air outlets on the top and the side of the air tube 1. As shown in FIG. 2, the top surface of the air tube 1 is an inclined surface. The higher end is defined as the front end. The top surface of the air tube 1 is provided with two support ribs 12 extending forward. The air outlet 11 is disposed between the two support ribs 12. An air flow channel may be formed through the support of the two support ribs 12. The front end of the support rib 12 forms an inclined support surface 120 which is gradually inclined upward along the length direction and is located at the front end of the air tube 1. By extending the support rib 12, the support space is enlarged and extends to the shoe body.

In the present invention, at least one guide passage 13 is provided inside the air tube 1 and is independent of the air passage 10. Through the guide passage, when the air tube is in operation, the air in the shoe body or the drying cavity can be prevented from being blocked, resulting in the backflow of warm air. It is avoided that the air in the shoe or the cavity cannot form airflow circulation, resulting in low efficiency of internal convective drying.

Figure 3:
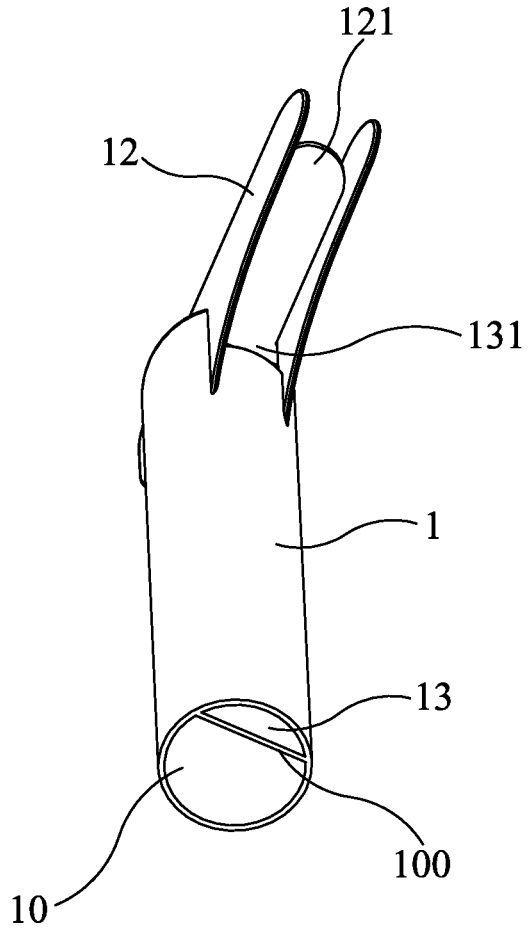
Figure 4:
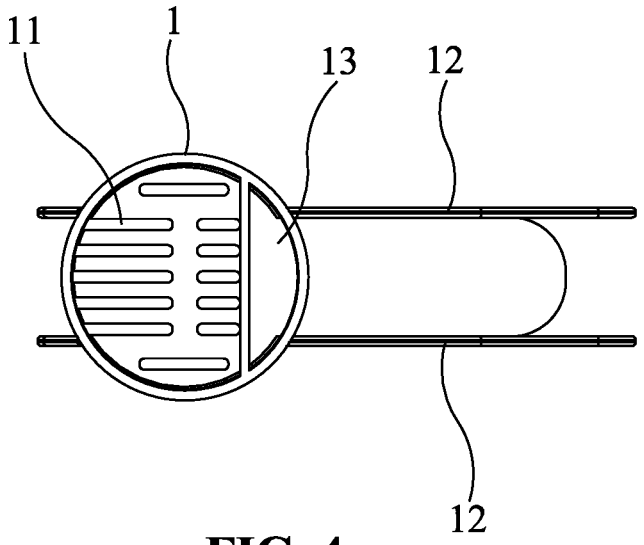
FIG. 4 is a bottom view according to the first embodiment of the present invention.

Specifically, FIGS. 1 to 4 illustrate a first embodiment of the present invention. In this embodiment, the air tube 1 is a hollow round tube. The guide passage 13 is disposed inside the air tube 1. The guide passage 13 is integrally formed with the air tube 10. The guide passage 13 may be formed through a half-closed shell surrounding the wall of the air tube. In this embodiment, as shown in FIG. 3 and FIG. 4, the interior of the air tube 1 is directly divided into the air passage 10 and the guide passage 13 by a plate 100. Only the top of the air passage 10 is provided with the air outlet 11. Both ends of the guide passage 13 are formed with openings. The opening at the lower end is located at the lower end of the air tube 1, and the opening 131 at the upper end is located on the outer side wall of the air tube 1. The opening 131 at the upper end is lower than the air outlet 11 on the top of the air tube 1. After the warm air is blown out from the air outlet 11, the air flow can be guided by the guide passage 13 because the opening 131 at the upper end of the guide passage 13 is located on the wall of the air tube 1. The internal air in the drying process can be circulated to the outside of the air tube 1, thereby avoiding the backflow of warm air and improving the convective drying efficiency inside the shoe or other drying cavities.

The guide passage 13 may be a passage having a semi-circular cross-section, which is partitioned and formed inside the air tube 1. Alternatively, a semi-closed shell in the form of a plate having other shapes is formed on the inner wall of the air tube 10. An independent passage in other shapes is formed inside the air tube 1.

Further, a baffle 121 is provided between the two support ribs 12 on the top surface of the air tube 1. The baffle 121 is located at the front end of the top surface of the air tube 1, and the baffle 121 is located above the guide passage 13. The arrangement of the baffle 121 may be changed according to the position of the guide passage located below the baffle 121. The baffle is located above the opening 131 of the guide passage 13. The baffle 121 is configured to provide separation and support between the guide passage 13 and the support ribs 12 for guiding the warm air flow to the front end of the shoe body and extending the area where the warm air flow passes, so that the warm air flow is maintained above the guide opening, and the warm air flow is turned over before being led out to the guide passage.

Figure 5:
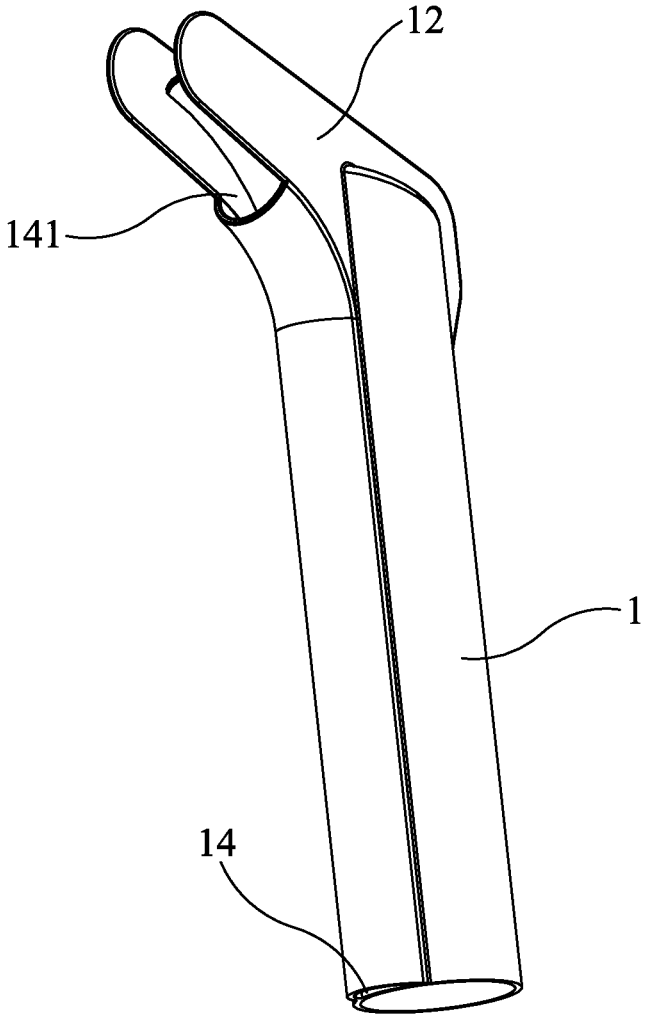
FIG. 5 and FIG. 6 are perspective views according to a second embodiment of the present invention.
Figure 6:
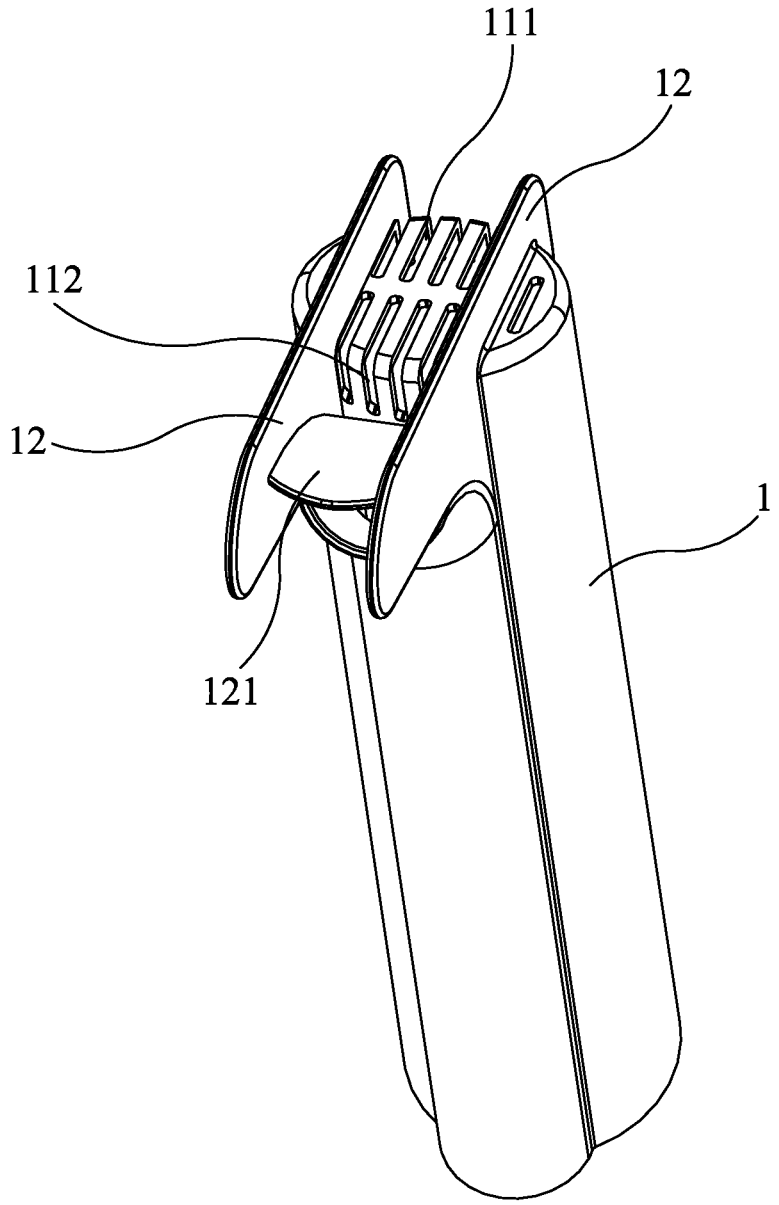
Figure 7:
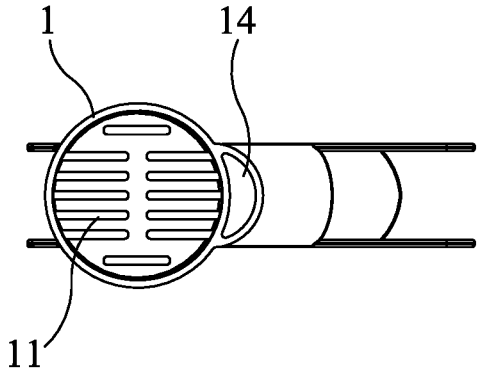
FIG. 7 is a bottom view according to the second embodiment of the present invention.

FIGS. 5 to 7 illustrate a second embodiment of the present invention. The second embodiment is substantially similar to the first embodiment with the exceptions described hereinafter. In this embodiment, the guide passage 14 is located on the outer side wall of the circular air tube 1. The guide passage 14 is formed through an arc-shaped plate surrounding the outer side wall of the air tube 1. The upper opening 141 of the guide passage 14 is located on the outer side wall of the air tube 1 and below the air outlet 11. In addition, as shown in FIG. 6, the air outlet 11 of the air tube 1 may include a top air outlet area 111 and a side air outlet area 112 on the side of the air tube 1. The side air outlet area 112 may be located on both sides of the top air outlet area. The side air outlet area 112 may be located at the front side and/or the rear side of the air tube 1. The front side of the air tube 1 is provided with the side air outlet area 112 as an emergency drainage passage. If the air outlet 111 on the top surface of the air tube 1 is blocked, the warm air is blown from the side air outlet area 112 toward the toe cap in front of the air tube. A baffle 121 is provided between the two support ribs 12 on the top surface of the air tube 1. The baffle 121 is located at the front end of the top surface of the air tube 1. The baffle 121 is also located in front of the side air outlet area 112. The baffle 121 is located above the guide passage 14.

Figure 8:
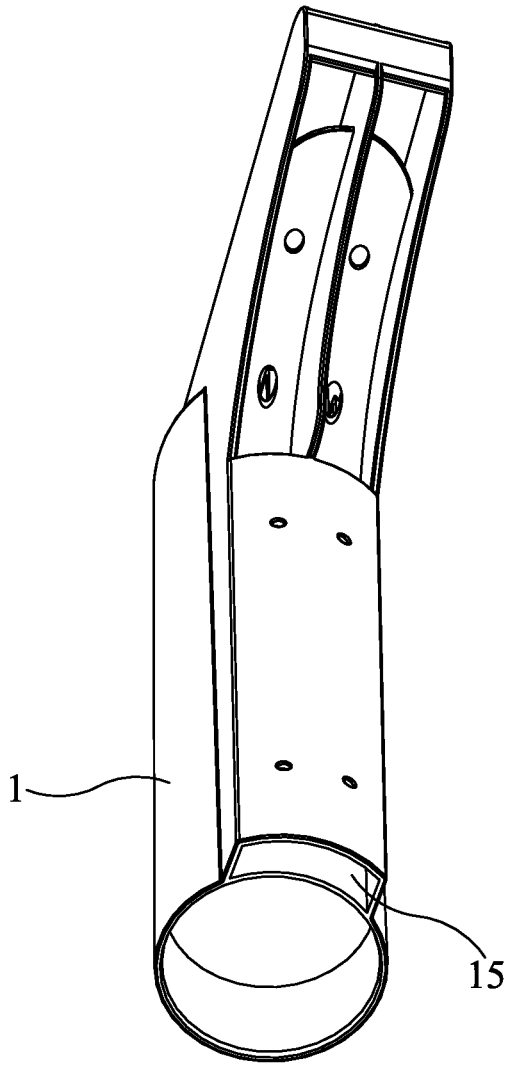
FIG. 8 and FIG. 9 are perspective views according to a third embodiment of the present invention.
Figure 9:
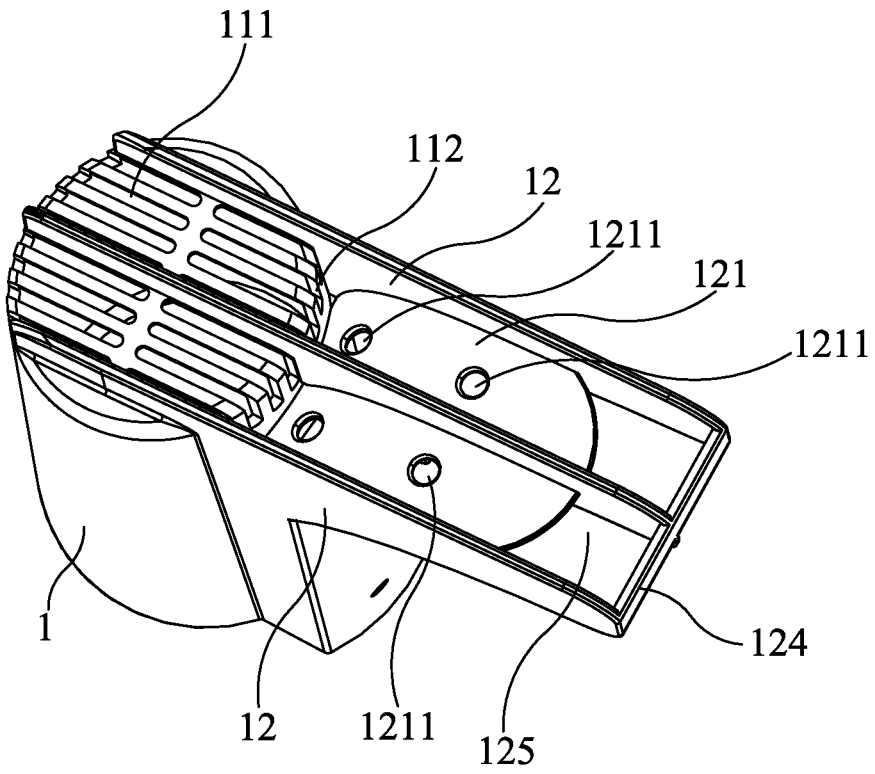
Figure 10:
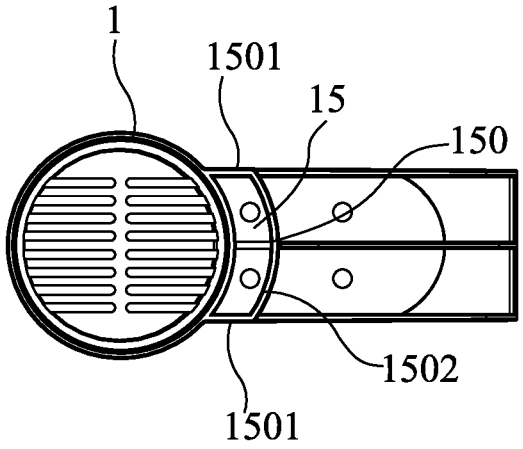
FIG. 10 is a bottom view according to the third embodiment of the present invention.

FIGS. 8 to 10 illustrate a third embodiment of the present invention. In this embodiment, the guide passage 15 is located on the outer side wall of the air tube 1, which is formed through a three-piece enclosure plate 150 formed on the outer side wall of the air tube 1. The three-piece enclosure plate 150 includes two side plates 1501 connected to the outer side walls of the air tube 1 and a connecting plate 1502 connected between the two side plates 1501. The connecting plate may be a curved plate. The guide passage 15 is formed on the outer side wall of the air tube 1, having a curved outer side.

As shown in FIG. 9, the top surface of the air tube 1 has a top air outlet area 111, and the front end of the air tube 1 has a side air outlet area 112. A baffle 121 is provided between the two support ribs 12 on the top surface of the air tube 1. The baffle 121 is located at the front end of the side air outlet area 112, and the baffle 121 is located above the guide passage 15. Further, the baffle 121 has at least one ventilation hole 1211. In this embodiment, the baffle 121 has four ventilation holes 1211. The two support ribs 12 support the front end of the shoe body. When the front end is blocked by the fluff in the shoe, the warm air can be discharged through the ventilation hole 1211 after coining out from the side air outlet area 112, so that the ventilation hole 1211 functions as an emergency exhaust to prevent the air outlet of the air tube from being blocked. The front ends of the two support ribs 12 are provided with a bar 124. The bar 124 is configured to block the long fluff at the toe cap of the shoe. A ventilation area 125 is formed between the bar 124 and the baffle 121. The bar 124 can prevent fuzz from blocking the ventilation area 125. After the warm air flow is turned over, it comes out from the ventilation area 125. The warm air flow is then guided through the guide passage, so that the utilization efficiency of the warm air flow can be improved.

Figure 11:
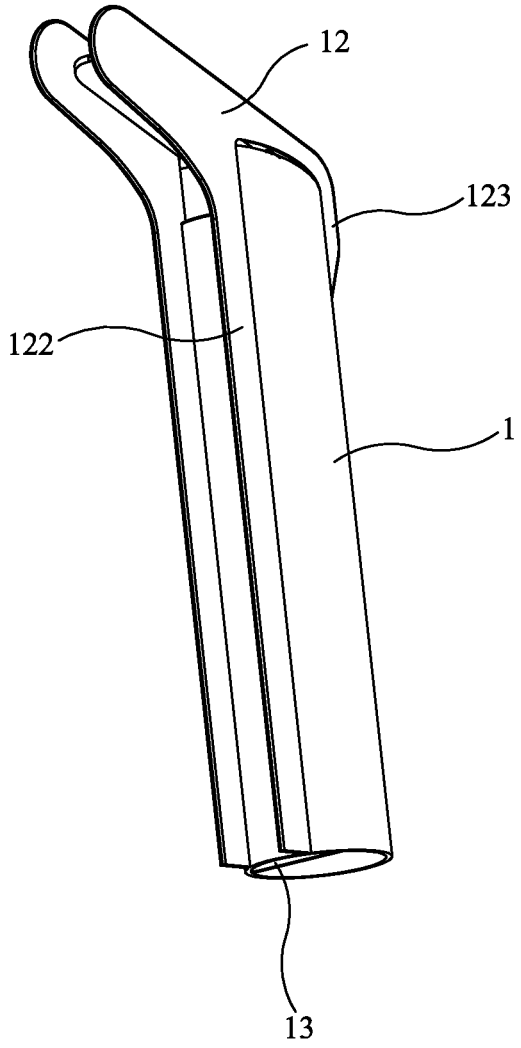
FIG. 11 is a perspective view according to a fourth embodiment of the present invention.
Figure 12:
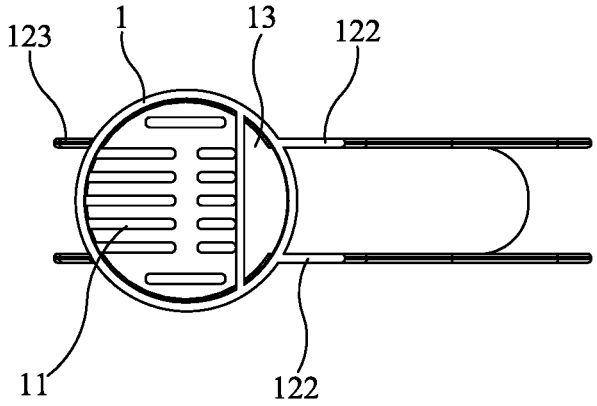
FIG. 12 is a bottom view according to the fourth embodiment of the present invention.

FIG. 11 and FIG. 12 illustrate a fourth embodiment of the present invention. The fourth embodiment is substantially similar to the above embodiments with the exceptions described hereinafter. A guide rib is provided on the outer side wall of the circular air tube 1 to speed up the warm air flow. At least one end of each support rib 12 extends downward to form a guide rib. The guide rib is integrally formed on the outer side wall of the air tube 1. In this embodiment, the top surface of the air tube 1 is provided with two support ribs 12. Both ends of each support rib 12 extend downward to form guide ribs 122, 123. A pair of parallel guide ribs are formed at the front end and the rear end of the air tube 1. The side air outlet area of the air outlet of the air tube 1 is located at the inner sides of the two air guide ribs 123 (not shown in the figures). As shown in FIG. 12, the guide passage 13 in this embodiment is the same as that of the first embodiment. The guide passage 13 is independently located in the air tube 1. The guide ribs 122, 123 are configured to support the space between the wall of the air tube and the inner surface of the ankle and calf area of the shoe to form an air exhaust and guide channel.

In addition, the guide passage is disposed on the outer side wall of the air tube. At least one pair of guide ribs extending downward to the lower end of the air tube are formed on the side wall of the air tube, so that the guide passage is located between the two guide ribs on the outer wall of the air tube. Since the guide passage will not be affected by the adsorption of cloth or fluff in the shoe, it can further accelerate the wane air flow and avoid blockage. Of course, the guide ribs may be separately formed on the side wall of the air tube. The support ribs and the guide ribs may be interlaced and formed separately.

Similarly, the air tube may be a hollow square tube or an oval tube, etc. The interior or the outer side wall of the air tube is provided with a guide passage in a different shape. When the air tube is provided with a guide rib, the air tube is provided with a variety of guide passages.

In summary, regardless of the shape of the air tube and whether there is a guide rib on the air tube, the shape of the guide passage formed on the air tube may be a semicircle, a circle, a square or other polygons, but not limited thereto. The interior or the outer wall of the air tube may be combined with a closed structure to form the air passage. The number of guide passages may be two or more.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. An air tube of a shoe dryer, a top of the air tube having at least one air outlet, an air passage being formed in the air tube, a top surface of the air tube being provided with at least one support rib; at least one guide passage being provided on an outer side wall of the air tube defined by an enclosure formed by a plate that encloses an area on the outer side wall of the air tube, or inside the air tube, the guide passage being independent of the air passage of the air tube.

2. The air tube of the shoe dryer as claimed in claim 1, wherein both ends of the guide passage are formed with openings, the openings are located on the outer side wall of the air tube, and a respective one of the openings at an upper end of the guide passage is lower than the air outlet on the top of the air tube.

3. The air tube of the shoe dryer as claimed in claim 1, wherein the guide passage is integrally formed with the air tube.

4. The air tube of the shoe dryer as claimed in claim 3, wherein the guide passage is formed through a half-closed shell surrounding the wall of the air tube.

5. The air tube of the shoe dryer as claimed in claim 1, wherein the guide passage has a semicircular, circular or square cross-section.

6. The air tube of the shoe dryer as claimed in claim 1, wherein at least one end of the support rib extends downward to form a guide rib, and the guide rib is integrally formed on the outer side wall of the air tube.

7. The air tube of the shoe dryer as claimed in claim 6, wherein the top surface of the air tube is provided with two support ribs, at least one end of each support rib extends downward to a side wall of the air tube, the side wall of the air tube is formed with at least one pair of guide ribs extending downward to a lower end of the air tube, and the guide passage on the outer side wall of the air tube is located between the two guide ribs.

8. The air tube of the shoe dryer as claimed in claim 1, wherein the top surface of the air tube is provided with two support ribs extending forward, a baffle is provided between the two support ribs, the baffle is located at a front end of the top surface of the air tube, and the baffle is located above the guide passage.

9. The air tube of the shoe dryer as claimed in claim 8, wherein the air outlet includes a top air outlet area on the top surface of the air tube and a side air outlet area on a front side of the air tube, and the baffle is located in front of the side air outlet area.

10. The air tube of the shoe dryer as claimed in claim 8, wherein the baffle has at least one ventilation hole.

11. The air tube of the shoe dryer as claimed in claim 8, wherein front ends of the two support ribs are provided with a bar, and a ventilation area is formed between the bar and the baffle.

12. The air tube of the shoe dryer as claimed in claim 1, wherein the air tube is a hollow round, square or oval tube.

* * * * *